US009376231B2

(12) United States Patent
Pinkstone

(10) Patent No.: US 9,376,231 B2
(45) Date of Patent: Jun. 28, 2016

(54) CARTON WITH CONTAINER

(71) Applicant: Graphic Packaging International, Inc., Atlanta, GA (US)

(72) Inventor: Felicia A. Pinkstone, Aston, PA (US)

(73) Assignee: Graphic Packaging International, Inc., Atlanta, GA (US)

( * ) Notice: Subject to any disclaimer, the term of this patent is extended or adjusted under 35 U.S.C. 154(b) by 49 days.

(21) Appl. No.: 14/089,989

(22) Filed: Nov. 26, 2013

(65) Prior Publication Data

US 2014/0175095 A1 Jun. 26, 2014

Related U.S. Application Data

(60) Provisional application No. 61/797,090, filed on Nov. 28, 2012.

(51) Int. Cl.

| | |
|---|---|
| ***B65D 5/54*** | (2006.01) |
| ***B65D 5/66*** | (2006.01) |
| ***B65B 5/02*** | (2006.01) |
| ***B65D 81/36*** | (2006.01) |

(52) U.S. Cl.

CPC ..... *B65D 5/5495* (2013.01); *B65B 5/028* (2013.01); *B65D 5/54* (2013.01); *B65D 5/6685* (2013.01); *B65D 81/36* (2013.01); *B65D 81/368* (2013.01)

(58) Field of Classification Search

CPC .... B65D 5/548; B65D 5/0005; B65D 5/5495; B65D 5/6685; B65D 5/54; B65D 5/028; B65D 5/42; B65D 81/36; B65D 81/368; B65D 2585/366

USPC ..... 229/101, 101.2, 103, 223, 240, 904

See application file for complete search history.

(56) References Cited

U.S. PATENT DOCUMENTS

| | | | | |
|---|---|---|---|---|
| 1,864,968 | A | 6/1932 | Weiner | |
| 2,046,751 | A * | 7/1936 | Reichel | B65D 5/4204 206/745 |
| 2,407,415 | A | 9/1946 | Graziano | |
| 2,769,971 | A | 6/1954 | Goldberg | |
| 2,833,458 | A | 5/1958 | Toensmeier | |
| 2,924,372 | A | 2/1960 | Kirkeby | |
| 3,003,584 | A | 10/1961 | Coe | |
| 3,167,240 | A | 1/1965 | Collura et al. | |
| 3,181,770 | A | 5/1965 | Coe | |

(Continued)

FOREIGN PATENT DOCUMENTS

| | | |
|---|---|---|
| EP | 1 106 518 A2 | 6/2001 |
| FR | 2 843 733 | 2/2004 |

(Continued)

OTHER PUBLICATIONS

International Search Report and Written Opinion for PCT/US2013/071811 dated Mar. 4, 2014.

*Primary Examiner* — Gary Elkins

(74) *Attorney, Agent, or Firm* — Womble Carlyle Sandridge & Rice, LLP

(57) ABSTRACT

A carton for containing at least one product. The carton comprises a plurality of panels that extends at least partially around an interior of the carton. The plurality of panels comprises a front panel, a back panel, and a bottom panel. The carton has a container removably attached to at least one panel of the plurality of panels. The container is for containing the food product after removal of the food product from the interior of the carton.

35 Claims, 7 Drawing Sheets

(56) References Cited

U.S. PATENT DOCUMENTS

| | | | | |
|---|---|---|---|---|
| 3,189,247 | A | 6/1965 | Wischusen | |
| 3,241,738 | A * | 3/1966 | Freiman | B65D 5/38 206/223 |
| 3,366,303 | A | 1/1968 | Kaspar | |
| 3,499,595 | A | 3/1970 | Brooks | |
| 3,680,766 | A | 8/1972 | Collura et al. | |
| 3,692,228 | A | 9/1972 | Spiegel | |
| 3,899,119 | A | 8/1975 | Roccaforte | |
| 4,105,155 | A | 8/1978 | Forbes, Jr. | |
| 4,185,764 | A | 1/1980 | Cote | |
| 4,252,264 | A | 2/1981 | Herbst et al. | |
| 4,278,197 | A | 7/1981 | Scheinbaum et al. | |
| 4,380,289 | A * | 4/1983 | Bigelow | 206/216 |
| 4,562,926 | A | 1/1986 | Mode | |
| 4,572,423 | A | 2/1986 | Spencer | |
| 4,590,349 | A | 5/1986 | Brown et al. | |
| D287,464 | S | 12/1986 | Mode | |
| 4,705,173 | A | 11/1987 | Forbes, Jr. | |
| 4,711,389 | A | 12/1987 | Alba et al. | |
| 4,746,010 | A * | 5/1988 | Fournier | 206/746 |
| 4,757,937 | A | 7/1988 | Maio et al. | |
| 4,804,133 | A | 2/1989 | Kiyokane | |
| 4,895,259 | A | 1/1990 | Paley | |
| 4,915,235 | A | 4/1990 | Roosa | |
| 4,955,528 | A | 9/1990 | Schluckebier | |
| 5,071,062 | A | 12/1991 | Bradley et al. | |
| 5,110,038 | A * | 5/1992 | Pantisano et al. | 229/103 |
| 5,205,474 | A | 4/1993 | Stuart et al. | |
| 5,314,114 | A | 5/1994 | Stone | |
| 5,328,089 | A | 7/1994 | Forbes, Jr. | |
| D353,091 | S | 12/1994 | Mumford | |
| 5,375,761 | A | 12/1994 | Sullivan et al. | |
| 5,402,889 | A | 4/1995 | Hermann et al. | |
| 5,464,150 | A | 11/1995 | Porres Sanchez et al. | |
| 5,601,230 | A * | 2/1997 | Bell | 229/103 |
| 5,605,279 | A | 2/1997 | Adamek | |
| 5,626,283 | A | 5/1997 | Mellon | |
| D394,606 | S | 5/1998 | Zorn et al. | |
| 5,788,081 | A | 8/1998 | Bates | |
| 5,806,754 | A | 9/1998 | Boyle | |
| 5,871,145 | A | 2/1999 | Hermann et al. | |
| 5,890,648 | A | 4/1999 | Cai | |
| 6,050,482 | A | 4/2000 | Cai | |
| 6,053,403 | A | 4/2000 | Cai | |
| 6,068,181 | A | 5/2000 | Cai | |
| 6,095,408 | A | 8/2000 | Nguyen | |
| 6,102,277 | A | 8/2000 | Krapohl, Sr. | |
| 6,119,930 | A | 9/2000 | Lunstra et al. | |
| 6,182,890 | B1 | 2/2001 | Sattler et al. | |
| 6,216,946 | B1 | 4/2001 | Cai | |
| D448,990 | S | 10/2001 | Sorensen et al. | |
| 6,375,066 | B1 | 4/2002 | Ritter | |
| 6,386,443 | B1 | 5/2002 | Szczerbinski | |
| 6,401,927 | B1 | 6/2002 | Sorensen et al. | |
| 6,402,021 | B1 | 6/2002 | Heathcock | |
| 6,440,050 | B1 | 8/2002 | Capparelli et al. | |
| 6,471,119 | B2 | 10/2002 | Cai | |
| D467,797 | S | 12/2002 | Sullivan | |
| 6,527,123 | B1 | 3/2003 | Ausaf | |
| 6,533,164 | B1 | 3/2003 | Correll | |
| 6,561,414 | B1 | 5/2003 | Cai | |
| 6,568,586 | B1 | 5/2003 | VanEsley et al. | |
| 6,634,547 | B2 | 10/2003 | Willis | |
| 6,719,190 | B2 | 4/2004 | Yocum | |
| 6,851,603 | B1 | 2/2005 | Carlson et al. | |
| 6,892,932 | B2 | 5/2005 | Correll | |
| 6,905,065 | B2 * | 6/2005 | Holden | 229/103 |
| 6,966,483 | B2 * | 11/2005 | Manninen | 229/103 |
| 6,988,614 | B2 | 1/2006 | Hemingway et al. | |
| 7,004,314 | B2 | 2/2006 | Pucillo et al. | |
| 7,007,837 | B2 | 3/2006 | Correll | |
| 7,051,919 | B1 | 5/2006 | Walsh | |
| 7,140,532 | B2 | 11/2006 | Holt et al. | |
| 7,182,242 | B2 | 2/2007 | Cai | |
| 7,232,055 | B1 | 6/2007 | Lim | |
| 7,273,162 | B2 | 9/2007 | Baker | |
| 7,293,695 | B2 | 11/2007 | Stier | |
| 7,306,135 | B2 | 12/2007 | DeBusk et al. | |
| 7,364,064 | B2 | 4/2008 | Kanamori et al. | |
| 7,484,653 | B2 | 2/2009 | Hirtado et al. | |
| 7,562,808 | B1 | 7/2009 | Philips | |
| 7,565,997 | B1 | 7/2009 | Lim | |
| 2003/0121961 | A1 | 7/2003 | Pilgrim et al. | |
| 2004/0101605 | A1 | 5/2004 | Sigel | |
| 2005/0045708 | A1 | 3/2005 | Bodary et al. | |
| 2006/0042989 | A1 | 3/2006 | Suter | |
| 2006/0191983 | A1 * | 8/2006 | Cargile, Jr. | 229/103 |
| 2006/0226206 | A1 * | 10/2006 | Reap | 229/103 |
| 2007/0063001 | A1 | 3/2007 | Sweet | |
| 2007/0074993 | A1 | 4/2007 | Philips | |
| 2010/0102110 | A1 | 4/2010 | Learn | |
| 2011/0198258 | A1 * | 8/2011 | Aldridge | 206/524.1 |

FOREIGN PATENT DOCUMENTS

| | | |
|---|---|---|
| GB | 1049168 | 11/1966 |
| GB | 1189877 | 4/1970 |
| WO | WO 96/06021 | 2/1996 |
| WO | WO 03/018407 A2 | 3/2003 |

* cited by examiner

CARTON WITH CONTAINER

CROSS-REFERENCE TO RELATED APPLICATION

This application claims the benefit of U.S. Provisional Application No. 61/797,090, filed on Nov. 28, 2012.

INCORPORATION BY REFERENCE

The disclosure of U.S. Provisional Application No. 61/797,090, filed Nov. 28, 2012, is hereby incorporated by reference as if presented herein in its entirety.

BACKGROUND OF THE DISCLOSURE

The present disclosure generally relates to a carton for holding food products or other types of articles. More specifically, the present disclosure relates to a carton having a removably attached container for holding food products or other types of articles.

SUMMARY OF THE DISCLOSURE

In general, one aspect of the disclosure is directed to a carton for containing at least one product. The carton comprises a plurality of panels that extends at least partially around an interior of the carton. The plurality of panels comprises a front panel, a back panel, and a bottom panel. The carton has a container removably attached to at least one panel of the plurality of panels. The container is for containing the food product after removal of the food product from the interior of the carton.

In another aspect, the disclosure is generally directed to a blank for forming a carton for containing a food product. The blank comprises a plurality of panels comprising a front panel, a back panel, and a bottom panel. The blank has a container panel removably attached to at least one panel of the plurality of panels. The container panel is for forming a container for containing the food product after removal of the food product from the interior of the carton formed from the blank.

In another aspect, the disclosure is generally directed to a method of forming a carton for containing a food product. The method comprises obtaining a blank comprising a plurality of panels comprising a front panel, a back panel, and a bottom panel, and a container panel removably attached to at least one panel of the plurality of panels. The method further comprises positioning the plurality of panels to form an interior of the container and positioning at least one food product in the interior of the container.

Other aspects, features, and details of the present disclosure can be more completely understood by reference to the following detailed description, taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designed by corresponding reference number throughout the drawings.

DETAILED DESCRIPTION OF THE EXEMPLARY EMBODIMENTS

The present disclosure generally relates to a carton or package with a removably attached container that is used to hold various products, such as any suitable consumer product that is suitable for holding in a carton or container for quick access and use. Such products can include food products such as rice, beans, and snacks for infants, toddlers, children, or adults, or any other suitable food product. Other products that can be held in the carton and container may include paint, epoxy resins, grout, or any other suitable product. Also, pet food and treats such as dog or cat treats, or any other suitable product, can be held in the carton or container. Furthermore, the removably attached container can be used to hold, mix, cook, or serve the aforementioned products.

Cartons according to the present disclosure can accommodate articles or containers of numerous different shapes. For the purpose of illustration and not for the purpose of limiting the scope of the disclosure, the following detailed description describes food product containers at least partially disposed within the carton embodiments. In this specification, the terms "lower," "bottom," "upper," "top," "side," "front," and "back" indicate orientations determined in relation to fully erected cartons, and such terms are not intended to limit the scope of the disclosure.

Figure 1:
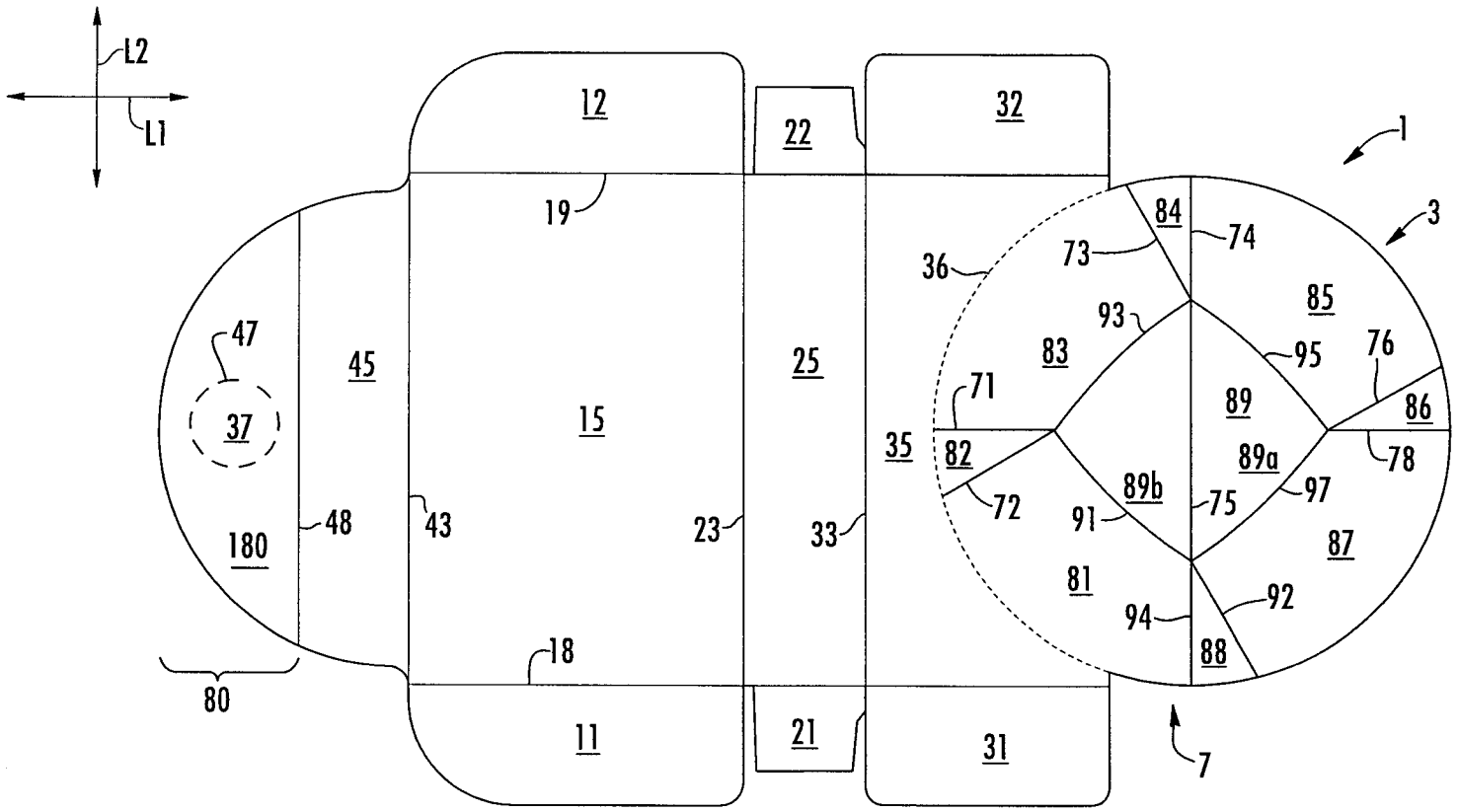
FIG. 1 is a plan view of an exterior surface of a blank for forming a carton according to one embodiment of the disclosure.

FIG. 1 is a plan view of the exterior side 1 of a blank, generally indicated at 3, used to form a carton 5 (FIGS. 2 and 3) according to a first exemplary embodiment of the disclosure. The carton 5 can be used to house one or more containers or packages P (shown by way of example in FIG. 2). In the illustrated embodiment, the carton 5 is sized to house two containers P in a face-to-face arrangement, but it is understood that the carton 5 may be sized and shaped to hold a plurality of containers P of different sizes and arrangements. The containers P can be otherwise shaped, arranged, and/or configured without departing from the disclosure. For example, containers P could be pouches, cans, plastic containers, or other containers. In the illustrated embodiment, the carton 5 has a compartment 8 capable of holding containers P, for example, during storage and transportation. The carton 5 includes a removably attached container panel, generally indicated at 7. The container panel 7 can be formed into a container 170 (FIG. 7) for holding, cooking, or serving the food products in the containers P. Additionally, the carton 5 can include a carton closure assembly capable of reclosing the carton 5.

According to an exemplary embodiment of the disclosure, the blank 3 has a longitudinal axis L1 that extends generally in the direction of the length of the blank and a lateral axis L2 that extends generally in the direction of the width of the blank. The blank 3 has a back panel 15, a top panel 45 foldably connected to the back panel 15 at a lateral fold line 43, a bottom panel 25 foldably connected to the back panel 15 at a lateral fold line 23, and a front panel 35 foldably connected to the bottom panel 25 at a lateral fold line 33. A top flap 80 is foldably connected to the top panel 45 at a lateral fold line 48. The blank 3 comprises a lid portion 49 that includes the top panel 45 and the top flap 80 and is for forming a lid 50 in the carton 5.

In one embodiment, the back panel 15 is foldably connected to a first end flap 11 and a second end flap 12. The bottom panel is foldably connected to a first end flap 21 and a second end flap 22. The front panel 35 is foldably connected to a first end flap 31 and a second end flap 32. When the carton 5 is erected, the end flaps 11, 21, 31 close one end 102 of the carton and the end flaps 12, 22, 32 close a second end 104 of the carton. In accordance with alternative embodiments of the disclosure, different flap arrangements can be used for closing the ends of the carton 5.

The end flaps 11, 21, 31 may extend along a first marginal area of the blank 3, and may be foldably connected at a first longitudinal fold line 18 that extends along at least a portion of the length of the blank 3. The end flaps 12, 22, 32 may extend along a second marginal area of the blank 3 and may be foldably connected at second longitudinal fold line 19 that also extends along at least a portion of the length of blank 3. The longitudinal fold lines 18, 19 may be, for example, substantially straight, or offset at one or more locations to account for blank thickness or other factors.

Figure 2:
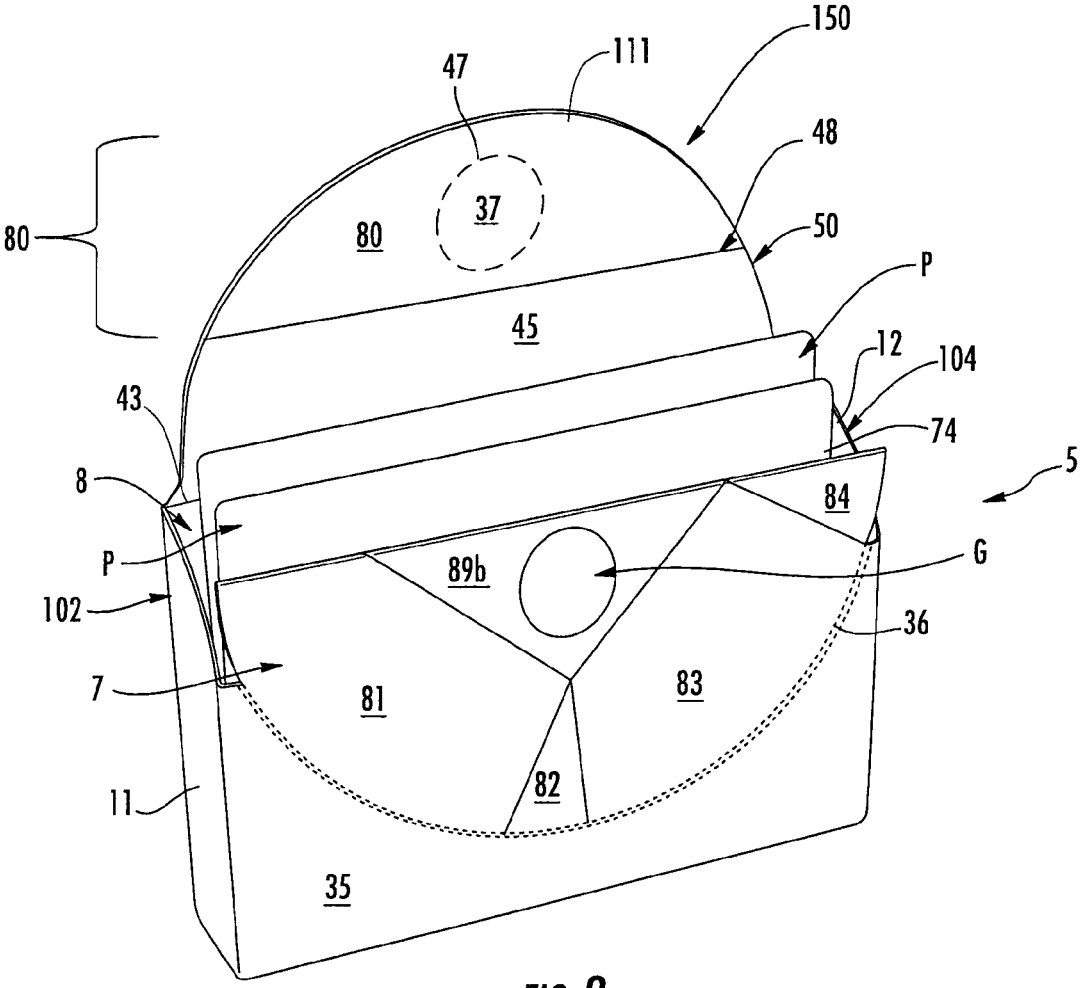
FIG. 2 is a perspective view of a carton in an open configuration.
Figure 4:
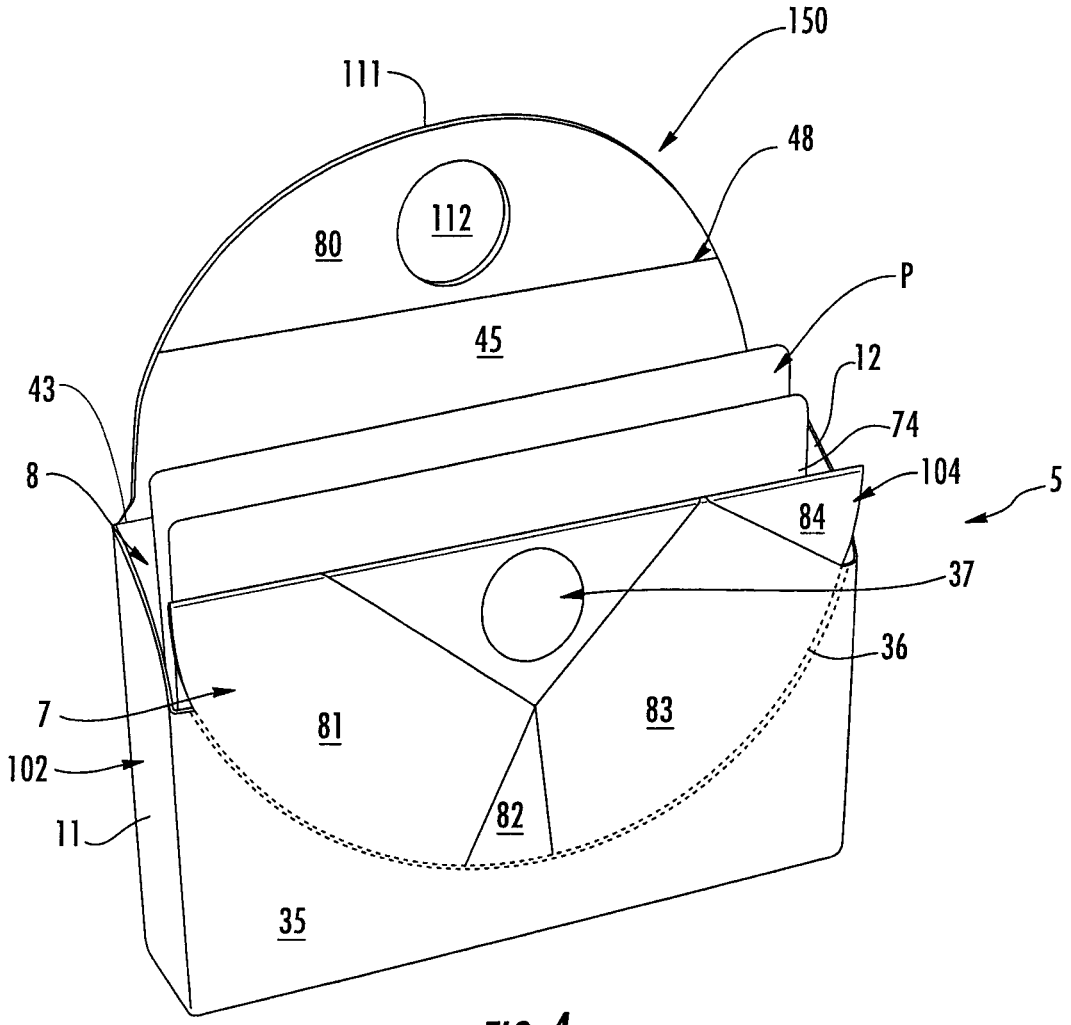
FIG. 4 is a perspective view of a carton in a reopened configuration.

As show in FIG. 2, the top flap has a curved edge 111. In one embodiment, top flap 80 comprises an attachment anchor 37 removably attached to the top flap 80. The attachment anchor 37 is generally circular shaped and is centered in the top flap 80 and defined by tear line 47 (i.e., "anchor tear line"). The attachment anchor 37 can be used to attach the top flap 80 to the front panel 35 by applying adhesive between the attachment anchor 37 and the front panel 35. Also, the attachment anchor 37 can be used as a latch that keeps the lid 50 in the closed position after opening the lid and reclosing the lid (e.g., when removing one of the two packages P and then closing the carton 5). As shown in FIG. 4, opening the lid 50 separates the attachment anchor 37 from the flap 80 and creates an attachment opening 112 in the flap 80. The attachment anchor 37 can be otherwise shaped, arranged, positioned, and/or configured without departing from the disclosure.

As shown in FIG. 1, the container panel 7 is removably attached to the front panel 35 along a tear line 36. In one embodiment, the tear line 36 is generally curved or arcuate and defines an edge of the container panel. Further, the tear line 36 can be, for example, a single tear line, multiple segmented tear lines, or a series of cut lines. The container panel 7 can be otherwise shaped, arranged, positioned, and/or configured without departing from the disclosure.

In the illustrated embodiment, the container panel 7 is substantially circular with a distal portion extending from the front panel 35. In one embodiment, the container panel 7 comprises a plurality of container side portions or panels 81, 83, 85, 87 foldably connected to a container bottom portion or panel 89 along fold lines 91, 93, 95, 97 respectively. The panels 81, 83, 85, 87 are separated by gusset panels 82, 84, 86, 88 defined by respective fold lines 71, 72, 73, 74, 76, 78, 92, 94. In one embodiment, the container bottom panel 89 has a lateral fold line 75 extending between the fold lines 74, 94 forming a respective gusset 84, 88. As shown in FIG. 1, the fold lines 74, 75, 94 are generally collinear and extend across the container panel 7 and dividing the container bottom panel 89 into bottom panel portions 89*a*, 89*b*. The container panel 7 can be otherwise shaped, arranged, positioned, and/or configured without departing from the disclosure. Upon forming the container 5, in one embodiment, the gussets 82, 84, 86, 88 may be attached to a respective one of the container side panels 81, 83, 85, 87 by adhesive such as glue, or the gussets may be free from attachment to the panels forming the container without departing from the disclosure.

One method for forming the carton 5 from the blank 3 will be described below, in accordance with one exemplary embodiment of the disclosure. In accordance with one exemplary embodiment, the blank 3 can be erected into the carton 5 by folding the container panel 7 along lateral fold lines 74, 75, 94 such that the panels 85, 87, gussets 86, 88 and the first portion 89*a* of the bottom panel 89 are in face-to-face contact with the panels 81, 83, gussets 82, 84 and a second portion 89*b* of the bottom panel. Then the back panel 15 is folded along lateral fold line 23 and the front panel 35 is folded along lateral fold line 33. The end flaps 11, 21, 31 can be overlapped to close a first end 102 of the compartment 8 and the end flaps 12, 22, 32 can be overlapped to close a second end 104 of the compartment. One or more of the first end flaps 11, 21, 31 and the second end flaps 12, 22, 32 can be overlapped and attached by adhesive such as glue to seal the closed ends 102, 104 of the compartment 8 to form the compartment 8 having a closed bottom and sides, and an open top.

Figure 3:
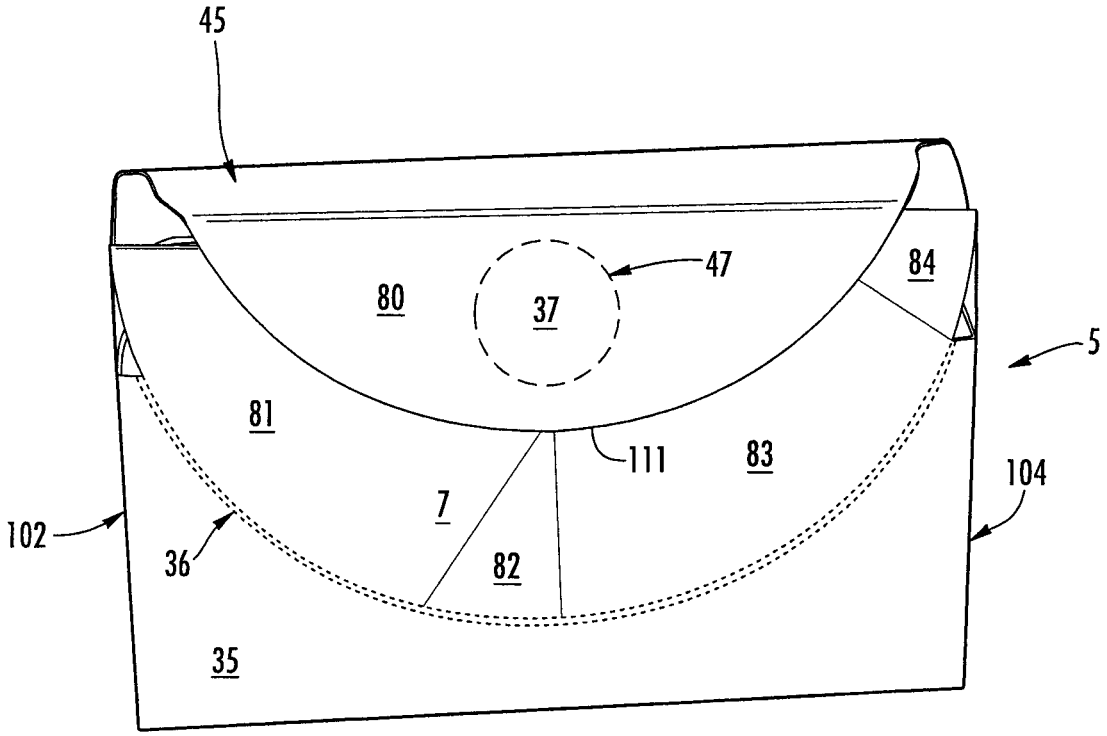
FIG. 3 is a perspective view of a carton in a closed configuration.

When the compartment 8 is formed, the lid 50 is in an open position corresponding to an open configuration of the carton 5 with the back panel 15, the top panel 45, and the top flap 80 generally in the same plane (FIG. 2). In the open configuration (FIG. 2), the carton 5 can receive one or more containers P in compartment 8. After the containers P have been placed in the compartment 8, the lid 50 can be moved to a closed position corresponding to a closed configuration of the carton. In the closed position, the top panel 45 is folded about fold line 43 and the top flap 80 is folded about fold line 48 and placed in face-to-face contact with the container panel 7 (FIG. 3). In one embodiment, the top flap 80 can be attached to the container panel 7 by adhesive attachment of the anchor portion 37 to the container panel 7 by use of a suitable adhesive G (e.g., glue). In the closed position, the curved edge 111 of the top flap is spaced apart from the curved tear line 36 and is positioned in an offset curved relationship thereto.

Figure 5:
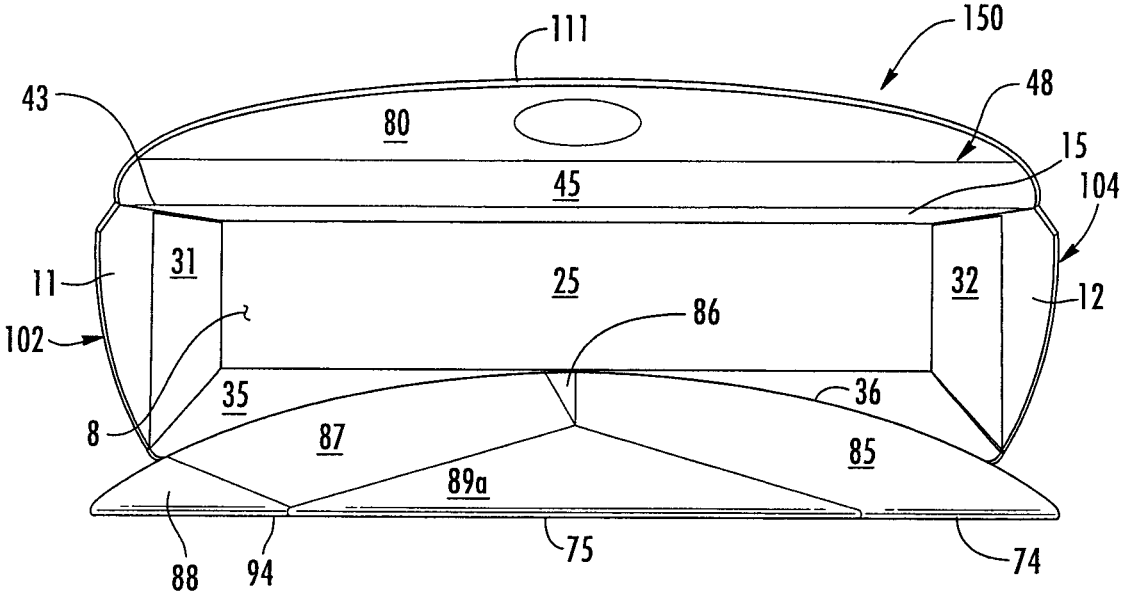
FIG. 5 is a top view of a carton in a reopened configuration with the product removed.
Figure 6:
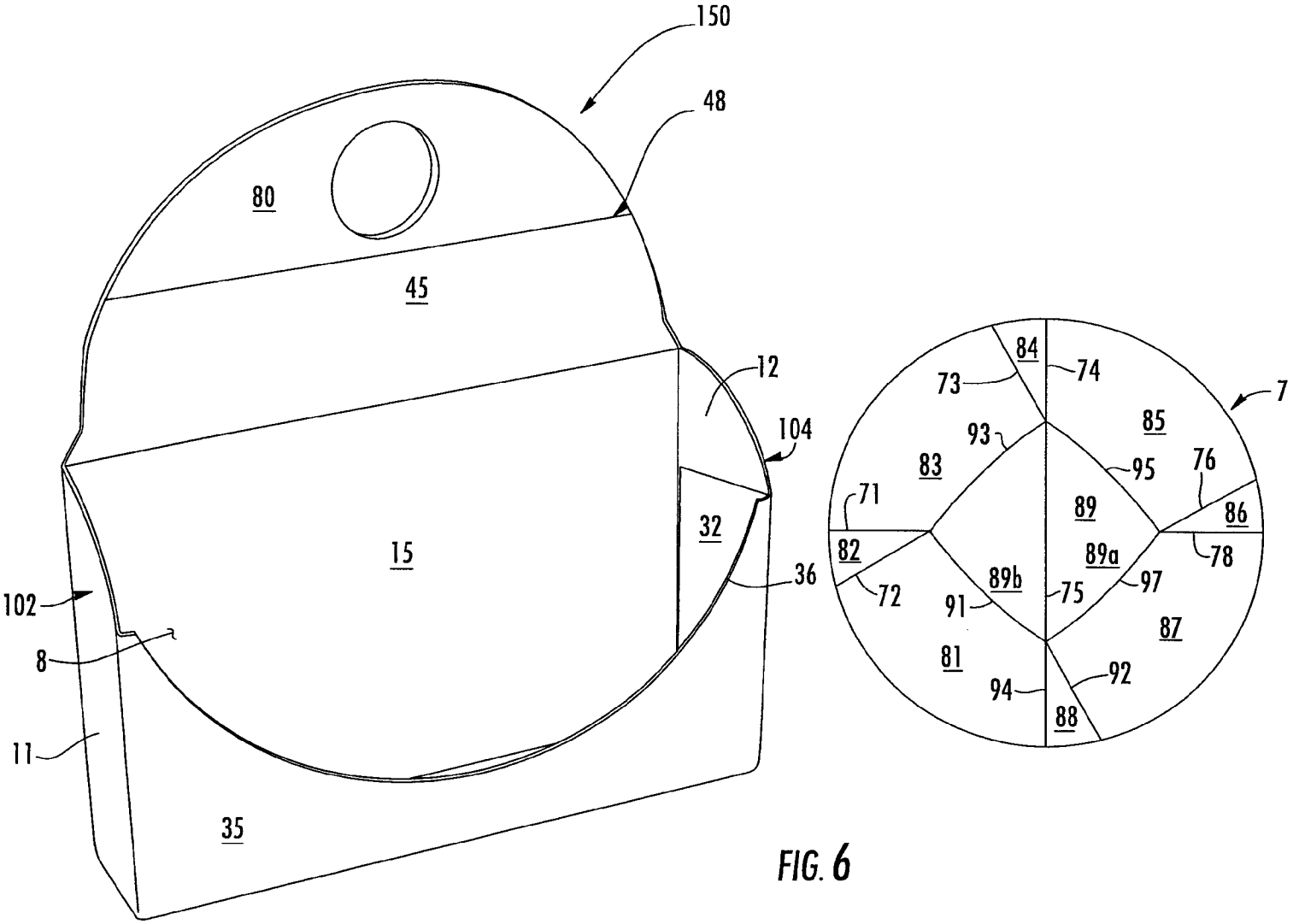
FIG. 6 is a perspective view of a carton with a container panel detached.
Figure 7:
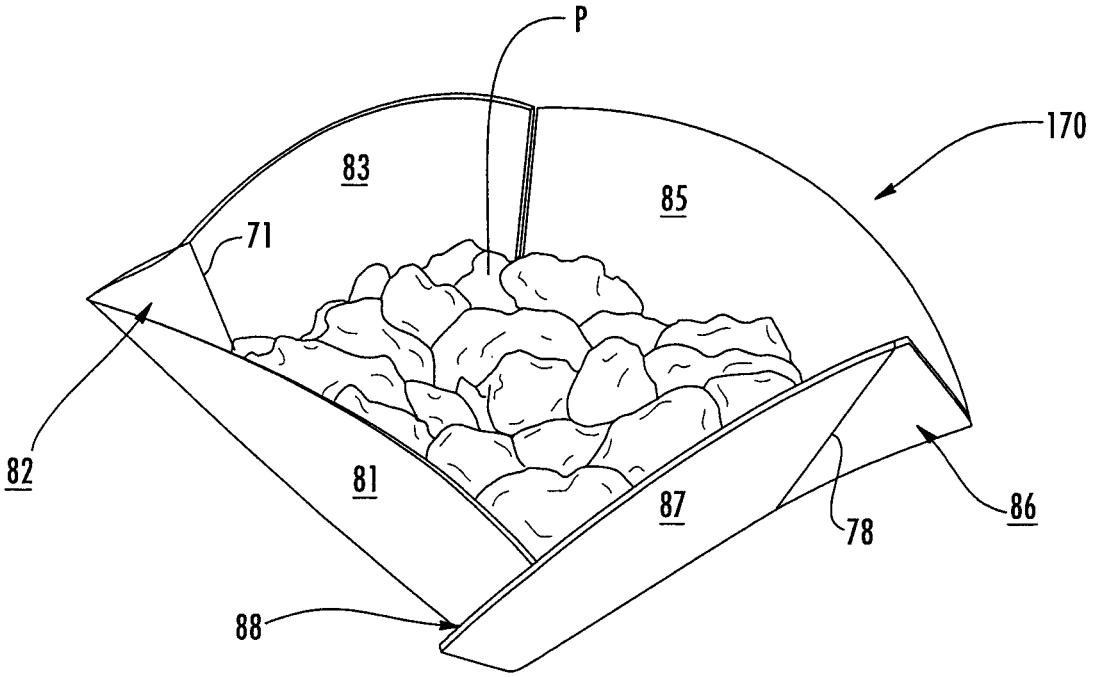
FIG. 7 is a perspective view of a container formed from the container panel.

In one embodiment, the carton 5 can be opened by grasping a portion of the top lid 50 (e.g., flap 80) and separating the anchor portion 37 from the top flap by tearing at tear line 47 and upwardly folding the top panel 45 (FIG. 3). Upon opening the lid 50, the compartment 8 and the container panel 7 can be accessed (FIGS. 4 and 5). One or more of the packages P can be removed from the carton 5, and the container panel 7 can be separated from the front panel 35 along tear line 36 (FIG. 6). After removal, the container panel 7 can be erected into container 170 by upwardly folding side panels 81, 83, 85, 87 along fold lines 91, 83, 95, 97 relative to the bottom panel 89. Gussets 82, 84, 86, 88 can be folded along fold lines 71, 72, 73, 74, 76, 78, 92, 94 to cooperate with the side panels 81, 83, 85, 87 that extend upwardly from the bottom panel 89 to form the container 170 having a three dimensional shape (FIG. 7). In one embodiment, the gussets 82, 84, 86, 88 can be glued to a respective adjacent panel 81, 83, 85, 87. Alternatively, the gussets 82, 84, 86, 88 can be free from adhesive connection to the panels 81, 83, 85, 87, and the gussets allow the container 170 to expand. The gussets 82, 84, 86, 88 are in foldable connection between adjacent ends of the side panels 81, 83, 85, 87 so that the container 170 can be aligned to generally comprise an eight-sided tray with the gussets forming short side panels extending between the longer side panels 81, 83, 85, 87. The container 170 can be generally bowl-shaped. In one embodiment, the food product can be removed from the package P, placed in the container, and the food product and container can be heated (e.g., in a microwave oven). Alternatively, the food product could be heated in the package P and then placed in the container 170.

The carton 5 and the container 170 can be formed by other alternative forming steps, and the carton 5 can be opened to access products within the compartment 8 by other steps without departing from the disclosure. Further, the container 170 could have other features and could be otherwise shaped, arranged, and/or configured without departing from the disclosure. For example, the container 170 could be a triangular-shaped tray having three sides without departing from the disclosure.

In general, the blank may be constructed from paperboard having a caliper so that it is heavier and more rigid than ordinary paper. The blank can also be constructed of other materials having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a food product, the carton comprising:

a plurality of panels that extends at least partially around an interior of the carton, the plurality of panels comprises a front panel, a back panel, and a bottom panel, the front panel being disposed opposite to the back panel;

a plurality of end flaps foldably connected to a respective panel of the plurality of panels, the plurality of end flaps comprises first side end flaps foldably connected to a respective panel of the plurality of panels to at least partially close a first side of the carton and second side end flaps foldably connected to a respective panel of the plurality of panels to at least partially close a second side of the carton;

a container removably attached to at least the front panel, the container being for containing the food product after removal of the food product from the interior of the carton, wherein the container is spaced apart from the back panel; and a lid foldably connected to at least the back panel, the lid at least partially closing a top end of the carton.

2. The carton of claim 1 wherein the container is removably attached to the front panel by a tear line.

3. The carton of claim 2 wherein the tear line is arcuate.

4. The carton of claim 1 wherein the container comprises a container panel at least partially defined by a tear line.

5. The carton of claim 4 wherein the container panel comprises a container bottom portion and a plurality of container side portions foldably connected to the container bottom portion.

6. The carton of claim 5 wherein the lid comprises a top panel and a closure flap foldably connected to the top panel, the top panel at least partially closing the interior of the carton.

7. The carton of claim 1 wherein the container is for being removed from the front panel, and the plurality of panels extends at least partially around the interior of the carton after the container is removed from the first panel.

8. The carton of claim 1 wherein the container has a free edge and is removably attached to the front panel along an arcuate tear line, the arcuate tear line being for forming a generally concave outer edge of the front panel and a generally convex edge of the container when the container is removed from front panel.

9. The carton of claim 1 wherein a protruding portion of the container protrudes from an edge of the front panel, and wherein at least a portion of the protruding portion is generally coplanar with the front panel.

10. The carton of claim 4, wherein a first portion of the container panel is coplanar with the front panel, and a second portion of the container panel overlaps the first portion.

11. A carton for containing a food product, the carton comprising:

a plurality of panels that extends at least partially around an interior of the carton, the plurality of panels comprises a front panel, a back panel, and a bottom panel, the front panel being disposed opposite to the back panel;

a container removably attached to at least the front panel, the container being for containing the food product after removal of the food product from the interior of the carton, wherein the container is spaced apart from the back panel; and a lid foldably connected to at least the back panel, the lid at least partially closing a top end of the carton; and wherein the container comprises a container panel at least partially defined by a tear line, and the container panel comprises a plurality of gusset panels, each of the plurality of gusset panels is foldably connected to respective adjacent container side portions of the plurality of container side portions.

12. The carton of claim 11 wherein the plurality of container side portions comprises four container side portions and the plurality of gusset panels comprises four gusset panels.

13. A carton for containing a food product, the carton comprising:

a plurality of panels that extends at least partially around an interior of the carton, the plurality of panels comprises a front panel, a back panel, and a bottom panel, the front panel being disposed opposite to the back panel;

a container removably attached to at least the front panel, the container being for containing the food product after removal of the food product from the interior of the carton, wherein the container is spaced apart from the back panel; and a lid foldably connected to at least the back panel, the lid at least partially closing a top end of the carton; and wherein the container comprises a container panel at least partially defined by a tear line, and the container panel is substantially circular.

14. A carton for containing a food product, the carton comprising:

a plurality of panels that extends at least partially around an interior of the carton, the plurality of panels comprises a front panel, a back panel, and a bottom panel, the front panel being disposed opposite to the back panel;

a container removably attached to at least the front panel, the container being for containing the food product after removal of the food product from the interior of the carton, wherein the container is spaced apart from the back panel; and a lid foldably connected to at least the back panel, the lid at least partially closing a top end of the carton; and wherein the container comprises a container panel at least partially defined by a tear line, the lid comprises a top panel and a closure flap foldably connected to the top panel, the top panel at least partially closing the interior of the carton, and the closure flap is in face-to-face contact with the container panel.

15. The carton of claim 14 wherein the closure flap has a curved edge, the curved edge of the closure flap being in an offset curved relationship to the tear line.

16. A carton for containing a food product, the carton comprising:

a plurality of panels that extends at least partially around an interior of the carton, the plurality of panels comprises a front panel, a back panel, and a bottom panel;

a container removably attached to at least one panel of the plurality of panels, the container being for containing the food product after removal of the food product from the interior of the carton, the container comprising a container panel at least partially defined by a tear line;

a lid foldably connected to the back panel, the lid comprising a top panel and a closure flap foldably connected to the top panel, the top panel at least partially closing the interior of the carton, and the closure flap being in face-to-face contact with the container panel;

wherein the closure flap comprises an attachment anchor, and the attachment anchor is removably attached to the closure flap at an anchor tear line.

17. The carton of claim 16 wherein the attachment anchor is adhesively secured to the container panel and the anchor tear line to create an attachment opening in the closure flap upon separation of the closure flap from the container panel.

18. A blank for forming a carton for containing a food product, the blank comprising:

a plurality of panels comprising a front panel, a back panel, and a bottom panel, wherein the front panel is for being disposed opposite to the back panel when the carton is formed from the blank;

a plurality of end flaps foldably connected to a respective panel of the plurality of panels, the plurality of end flaps comprises first side end flaps foldably connected to a respective panel of the plurality of panels to at least partially close a first side of the carton and second side end flaps foldably connected to a respective panel of the plurality of panels to at least partially close a second side of the carton;

a container panel removably attached to at least the front, the container panel being for forming a container for containing the food product after removal of the food product from the interior of the carton formed from the blank, wherein the container panel is spaced apart from the back panel; and a lid foldably connected to at least the back panel, the lid being for at least partially closing interior top end of the carton formed from the blank.

19. The blank of claim 18 wherein the container panel is removably attached to the front panel by a tear line.

20. The blank of claim 19 wherein the tear line is arcuate.

21. The blank of claim 18 wherein the container panel comprises a container bottom portion and a plurality of container side portions foldably connected to the container bottom portion.

22. The blank of claim 18 wherein the lid comprises a top panel and a closure flap foldably connected to the top panel, the top panel being for at least partially closing the interior of the carton formed from the blank.

23. A blank for forming a carton for containing a food product, the blank comprising:

a plurality of panels comprising a front panel, a back panel, and a bottom panel, wherein the front panel is for being disposed opposite to the back panel when the carton is formed from the blank;

a container panel removably attached to at least the front, the container panel being for forming a container for containing the food product after removal of the food product from the interior of the carton formed from the blank, wherein the container panel is spaced apart from the back panel; and a lid foldably connected to at least the back panel, the lid being for at least partially closing interior top end of the carton formed from the blank; and wherein the container panel comprises a container bottom portion and a plurality of container side portions foldably connected to the container bottom portion, and the container panel comprises a plurality of gusset panels, each of the plurality of gusset panels is foldably connected to respective adjacent container side portions of the plurality of container side portions.

24. The blank of claim 23 wherein the plurality of container side portions comprises four container side portions and the plurality of gusset panels comprises four gusset panels.

25. A blank for forming a carton for containing a food product, the blank comprising:

a plurality of panels comprising a front panel, a back panel, and a bottom panel, wherein the front panel is for being disposed opposite to the back panel when the carton is formed from the blank;

a container panel removably attached to at least the front, the container panel being for forming a container for containing the food product after removal of the food product from the interior of the carton formed from the blank, wherein the container panel is spaced apart from the back panel; and a lid foldably connected to at least the back panel, the lid being for at least partially closing interior top end of the carton formed from the blank; and wherein the container panel comprises a container bottom portion and a plurality of container side portions foldably connected to the container bottom portion, and the container panel is substantially circular.

26. A blank for forming a carton for containing a food product, the blank comprising:

a plurality of panels comprising a front panel, a back panel, and a bottom panel;

a container panel removably attached to at least one panel of the plurality of panels, the container panel being for forming a container for containing the food product after removal of the food product from the interior of the carton formed from the blank; and a lid foldably connected to the back panel, the lid comprising a top panel and a closure flap foldably connected to the top panel, the top panel being for at least partially closing the interior of the carton formed from the blank;

wherein the closure flap has a curved edge, and the closure flap comprises an attachment anchor, and the attachment anchor is removably attached to the closure flap at an anchor tear line.

27. The blank of claim 26, wherein the at least one panel is the front panel, and the container panel is removably attached to the front panel by a tear line.

28. A method of forming a carton for containing a food product, the method comprising:

obtaining a blank comprising a plurality of panels comprising a front panel, a back panel, a bottom panel, a container panel removably attached to at least the front panel, and a lid foldably connected to at least the back panel, wherein the container panel is spaced apart from the back panel; and the blank further comprising a plurality of end flaps foldably connected to a respective panel of the plurality of panels, the plurality of end flaps comprises first side end flaps foldably connected to a respective panel of the plurality of panels and second side end flaps foldably connected to a respective panel of the plurality of panels;

positioning the plurality of panels to form an interior of the container, the positioning the plurality of panels comprising disposing the front panel to be opposite the back panel;

positioning at least one food product in the interior of the container; and positioning the lid to at least partially close a top end of the carton.

29. The method of claim 28 further comprising positioning the lid to at least partially open the interior and removing the at least one food product.

30. The method of claim 29 further comprising detaching the container panel and forming the container panel into a container.

31. The method of claim 30 wherein the detaching the container panel comprises tearing the container panel at a tear line that removably attaches the container panel to the front panel.

32. The method of claim 31 wherein the container panel comprises a container bottom portion and a plurality of container side portions foldably connected to the container bottom portion.

33. A method of forming a carton for containing a food product, the method comprising:

obtaining a blank comprising a plurality of panels comprising a front panel, a back panel, and a bottom panel, a container panel removably attached to at least the front panel, and a lid foldably connected to at least the back panel, wherein the container panel is spaced apart from the back panel and the container panel comprises a container bottom portion and a plurality of container side portions foldably connected to the container bottom portion;

positioning the plurality of panels to form an interior of the container, the positioning the plurality of panels comprising disposing the front panel to be opposite the back panel;

positioning at least one food product in the interior of the container;

positioning the lid to at least partially close a top end of the carton;

positioning the lid to at least partially open the interior and removing the at least one food product;

detaching the container panel and forming the container panel into a container, the detaching the container panel comprises tearing the container panel at a tear line that removably attaches the container panel to the front panel, and the forming the container panel into the container comprises positioning the container side portions upwardly relative to the bottom portion so that the container is generally bowl-shaped.

34. The method of claim 33 wherein the container panel comprises a plurality of gusset panels, each of the plurality of gusset panels is foldably connected to respective adjacent container side portions of the plurality of container side portions, the forming the container panel into the container comprises at least partially overlapping a respective gusset with a respective side portion.

35. The method of claim 30 further comprising placing the at least one food product in the container and heating the food product and the container.

* * * * *